US009255448B2

(12) United States Patent
Oesterberg et al.

(10) Patent No.: US 9,255,448 B2
(45) Date of Patent: Feb. 9, 2016

(54) REAMING SHOE FOR INCREASED BOREHOLE CLEARANCE AND METHOD OF USE

(75) Inventors: Marcus Oesterberg, Kingwood, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 926 days.

(21) Appl. No.: 13/428,916

(22) Filed: Mar. 23, 2012

(65) Prior Publication Data

US 2013/0248252 A1 Sep. 26, 2013

(51) Int. Cl.

| | |
|---|---|
| ***E21B 10/32*** | (2006.01) |
| ***E21B 7/28*** | (2006.01) |
| ***E21B 23/00*** | (2006.01) |
| ***E21B 7/20*** | (2006.01) |

(52) U.S. Cl.

CPC . *E21B 10/32* (2013.01); *E21B 7/20* (2013.01); *E21B 7/28* (2013.01); *E21B 10/322* (2013.01); *E21B 23/00* (2013.01)

(58) Field of Classification Search

CPC ... E21B 10/322; E21B 10/327; E21B 10/325; E21B 10/40; E21B 10/32; E21B 10/26; E21B 10/62; E21B 43/10; E21B 43/103; E21B 43/106; E21B 7/20; E21B 23/00; E21B 7/28

See application file for complete search history.

(56) References Cited

U.S. PATENT DOCUMENTS

| | | | | |
|---|---|---|---|---|
| 7,703,553 | B2 | 4/2010 | Eddison et al. | |
| 2003/0164251 | A1 | 9/2003 | Tulloch | |
| 2004/0134687 | A1 | 7/2004 | Radford et al. | |
| 2004/0222022 | A1 | 11/2004 | Nevlud et al. | |
| 2005/0145417 | A1 * | 7/2005 | Radford et al. | 175/57 |
| 2007/0215348 | A1 * | 9/2007 | Corre et al. | 166/264 |
| 2010/0089583 | A1 * | 4/2010 | Xu et al. | 166/298 |
| 2010/0175927 | A1 | 7/2010 | Zulak | |

* cited by examiner

*Primary Examiner* — David Bagnell
*Assistant Examiner* — Kristyn Hall
(74) *Attorney, Agent, or Firm* — Steve Rosenblatt

(57) ABSTRACT

An articulated reaming tool is provided in casing or liner drilling on or through the tubular wall with the articulation occurring from within the tubular. Outer limit travel stops are contemplated to optionally be used to retain the elements or blades to the tubular. In the case of liner drilling the drill string has an exterior protrusion to engage the movable components that ream and extend them to increase the clearance for the tubular as the tubular advances when more hole is made.

26 Claims, 9 Drawing Sheets

REAMING SHOE FOR INCREASED BOREHOLE CLEARANCE AND METHOD OF USE

FIELD OF THE INVENTION

The field of the invention is casing or liner drilling and more particularly with an articulated reaming tool mounted to the casing or liner to provide enhanced clearance for the advancing tubular.

BACKGROUND OF THE INVENTION

Casing or liner drilling advances a casing or liner string at the same time as the bit on the drill string makes more hole. One significant concern when doing casing or liner drilling is the close clearance around the casing or liner that is defined by the open hole and the risk of sticking the casing or the liner string before reaching the desired depth. Additionally the annulus equivalent circulating density (ECD) is significantly higher than in standard drill pipe drilling situations. Drilling with Casing exerts a higher pressure on the wellbore and may require lower circulation rates or risk losing the wellbore prematurely.

An additional benefit of increasing the annulus between the casing and the wellbore is to allow more cement in place for additional protection and increased security for a complete cement bond.

FIG. 1 illustrates a known system for casing drilling. A drilling rig 5 drives the casing string 12 that has a drill bit 14 at a lower end 16. FIG. 1 is not drawn to scale. The annulus 26 between the casing string 12 and the borehole wall 22 is small and can lead to stuck pipe and higher ECD's.

FIG. 2 illustrates a liner drilling application where a drill string 30 supports a liner 32 through a liner hanger 39 and has a bottom hole assembly that comprises of a drill bit 34 and a bottom hole assembly (BHA) 31. The BHA 31 comprises, for example, of the drill bit 34 a steerable device 35 for deflecting the well bore, an MWD system 37 and an underreamer 36.

Typically the underreamer 36 does not increase the borehole wall sufficiently to increase the clearance for the liner. In the prior art a special coring bit 40 or another stationary reamer further increase the hole to the new borehole wall 44. Due to the fixed width of the core bit or the stationary reamer 40 the annulus is slim and leads to the already mentioned operational problems. This clearance is given by the drift internal diameter of the previous casing string and operators typically accept this deficiency for the benefit of Liner Drilling.

The underreamer 36 when fully extended provides a minimal clearance from the outer surface 42 of the liner 32 and the borehole wall 44. A stationary reaming device 40 is mounted to the outer surface 42 to somewhat increase the clearance for the liner 32 created by the underreamer 36. The clearance increase from the reaming device 40 is marginal over the clearance that would have been there without reaming device 40. There are limits to the blade extension of underreamer 36. Trying to ream bigger hole sizes 44 with reaming tool 36 weakens the blades of the underreamer 36 with a risk of bending or fatigue breaking them creating the potential risk that the underreamer 36 will not be able to collapse for extraction through the liner 32 or a risk that parts could be lost in the hole.

The present invention focuses on an articulated reamer mounted to the casing or the liner so that the reaming starts from the outer surface and can better assure that a clearance is provided to the open hole so that the casing or liner will not stick even when negotiating a well deviation. Details of some ways to accomplish the reamer extension and the retention of the reamer blades or components are described. Those skilled in the art will understand from the description of the preferred embodiment and the associated drawings additional details of the present invention while understanding that the full scope of the invention is to be found in the appended claims.

SUMMARY OF THE INVENTION

An articulated reaming tool is provided in casing or liner drilling on or through the tubular wall with the articulation occurring from within the tubular. Outer limit travel stops are contemplated to optionally be used to retain the elements or blades to the tubular. In the case of liner drilling the drill string has an exterior protrusion to engage the movable components that ream and extend them to increase the clearance for the tubular as the tubular advances when more hole is made.

DETAILED DESCRIPTION OF THE PREFERRED EMBODIMENT

Figure 1:
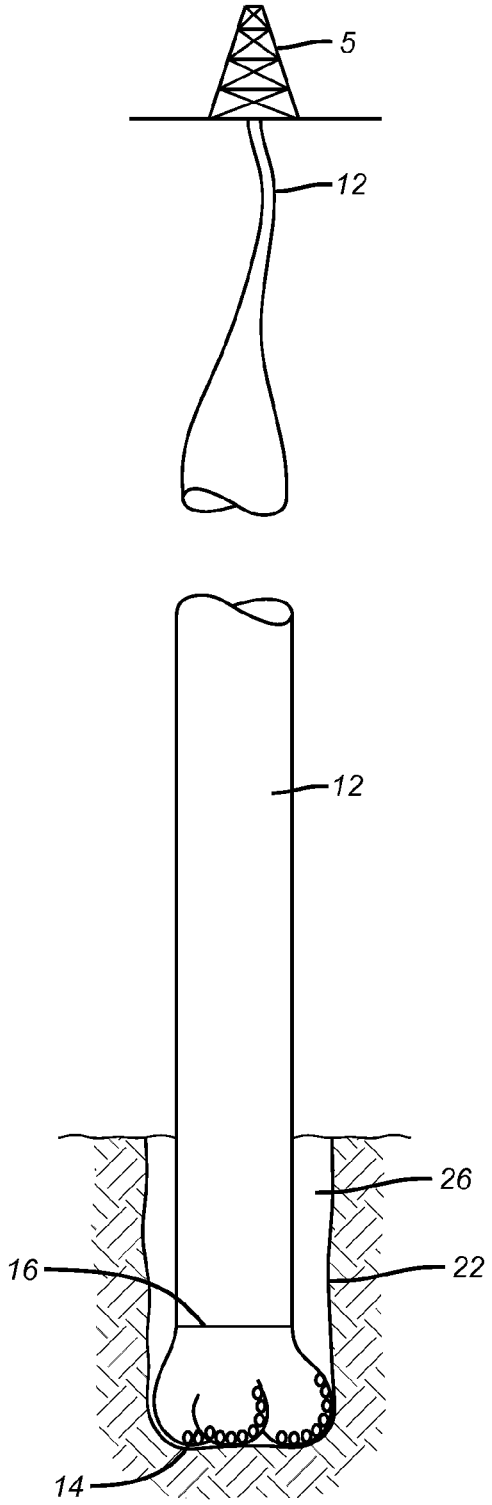
(PRIOR ART) FIG. 1
FIG. 1 is a schematic presentation of a prior art technique for casing drilling with a Casing Drilling bit defining the annulus between casing and borehole wall.
Figure 2:
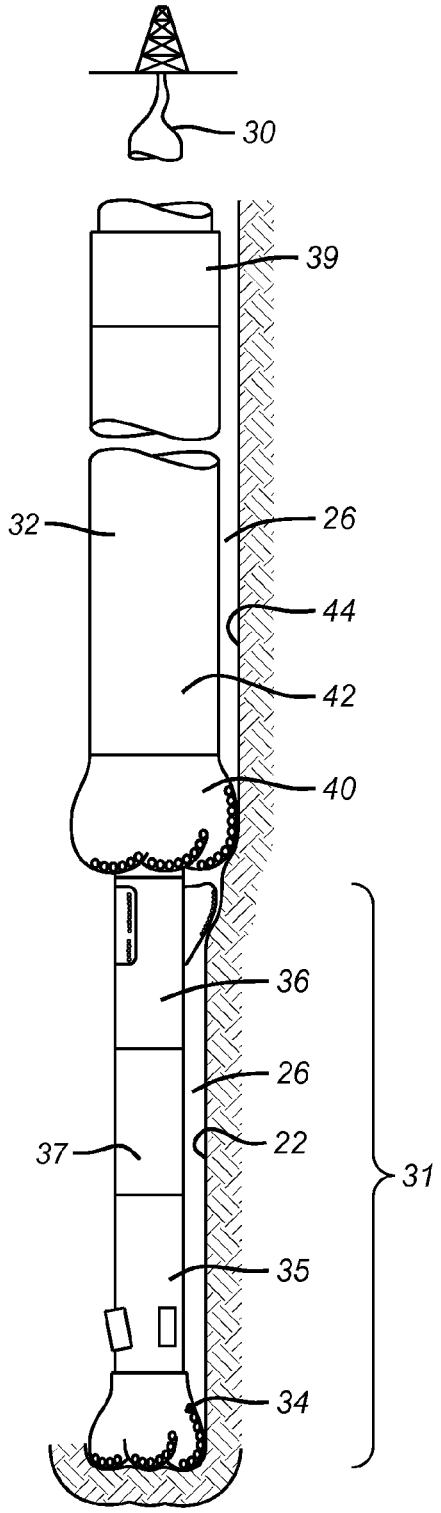
(PRIOR ART) FIG. 2
FIG. 2 is a schematic presentation of a prior art technique for liner drilling with a fixed reamer tool on the outer liner surface.
Figure 3:
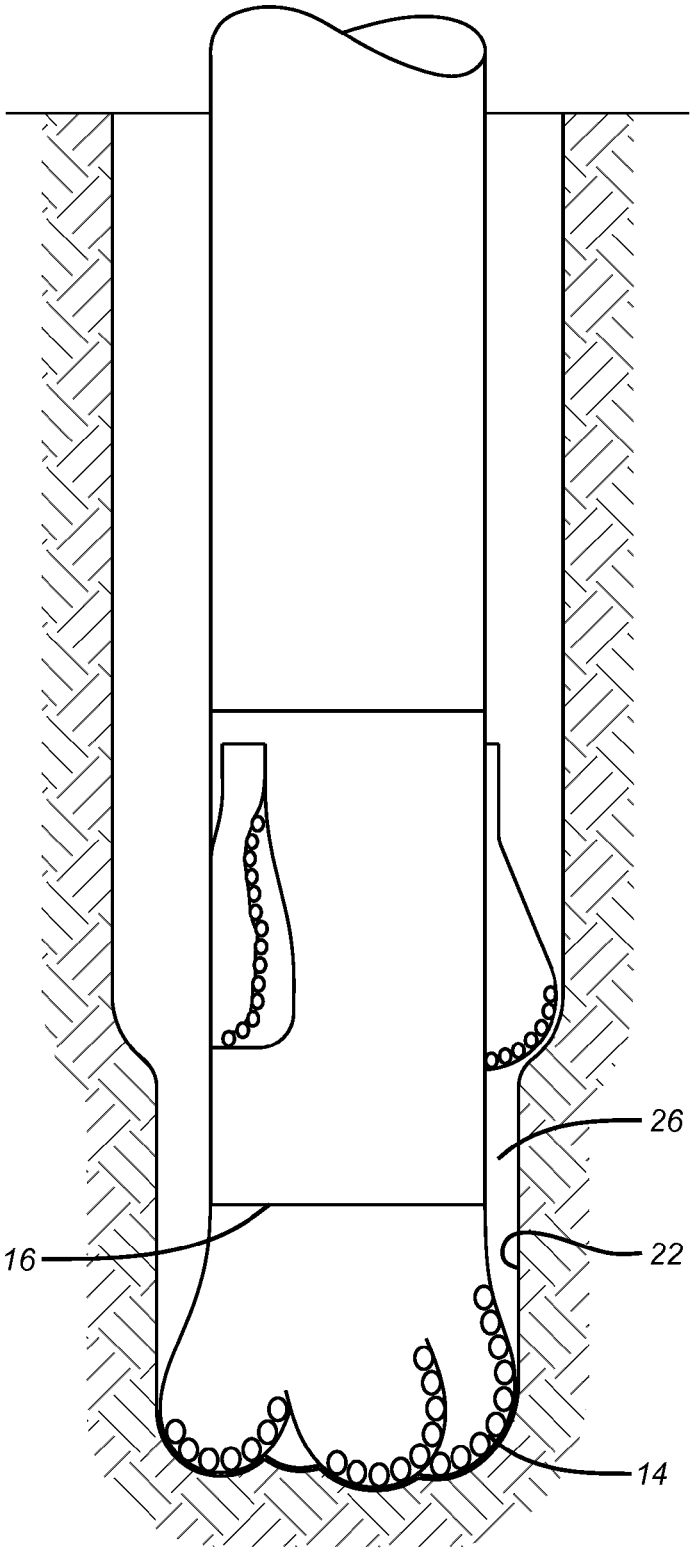
FIG. 3 shows the use of an articulated reamer that extends beyond the tubular outer surface and that is articulated from within.
Figure 4:
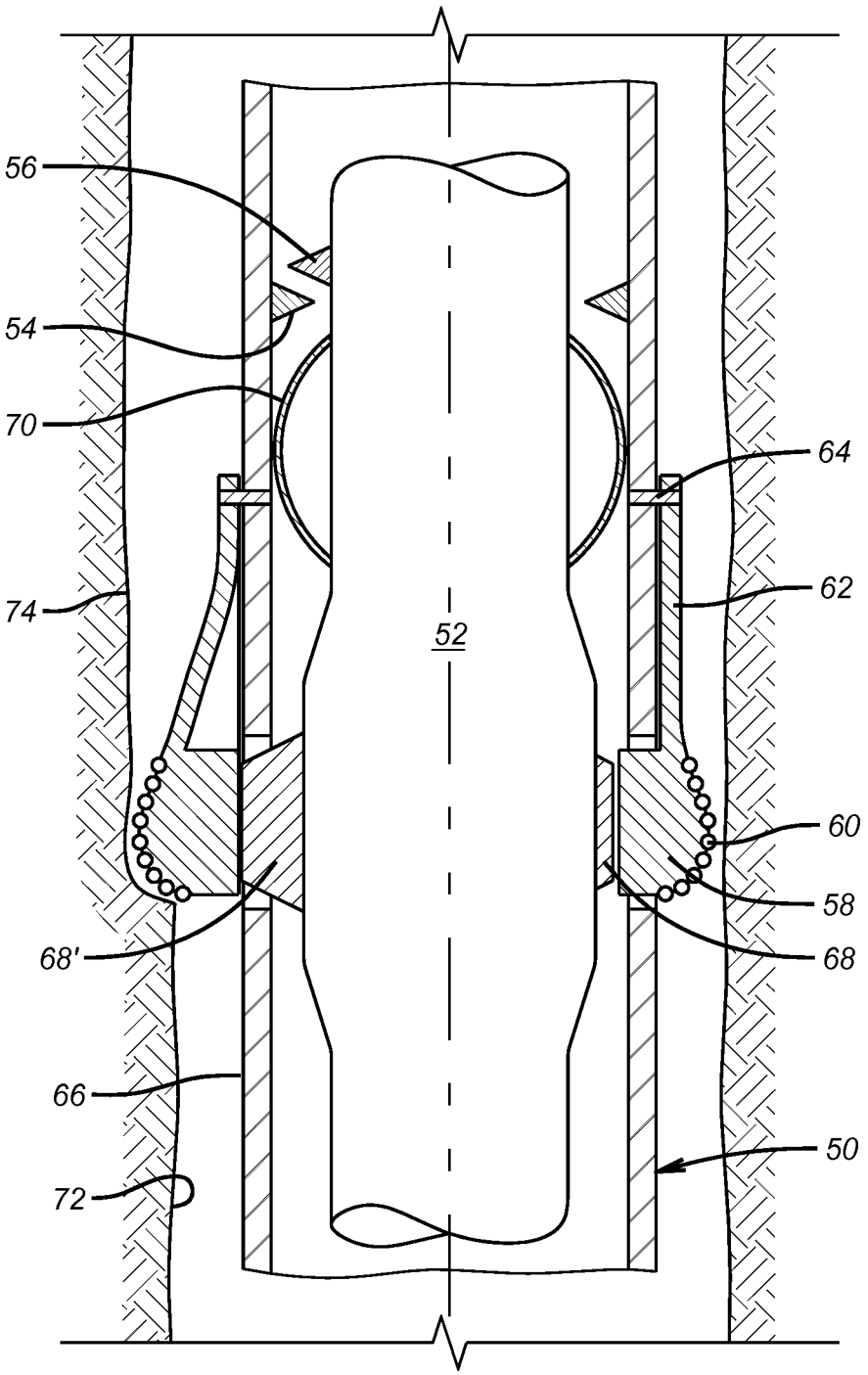
FIG. 4 shows the activation method of an articulated reamer that extends beyond the tubular outer surface and that is articulated from within.

FIG. 4 illustrates the casing or liner string 50 that is supported on a drill string and that is meant to be advanced as more hole is drilled, in the manner previously described for FIG. 1 or 2. Supported internally in the casing or liner string 50 is a schematically illustrated tool 52 that can land on a schematically illustrated landing shoulder 54 and latch to it using a schematically illustrated latch mechanism 56. Although one example of tool positioning is illustrated others can be used and alternative no go designs can be deployed within the scope of the invention. Alternatively, some other alignment technique for extending the blades 58 with the peripheral cutting structure 60 can be used. FIG. 4 shows a flexible link 62 extending up from each blade to a fixation location 64. The attachment can be with a fastener or welded. Alternatively, there can be mirror image links 62 extending in opposed directions from the blades 58. As another alternative, the link 62 and at least part of the blade structure can be cut from the wall of the casing or liner 50 and additional material welded on to create blades 58. With this alternative and putting in a built in radial bias inwardly, the blades 58 and cutting structure 60 can be disposed to not extend beyond outer surface 66 until the tool 52 is advanced to the FIG. 4 position. That way there will be no external structure hanging out to get snagged such as when the liner or casing 50 is advancing through another tubular. The cutting out the blades 58 and links 62 from the casing or tubular 50 can be done by wire EDM or other cutting techniques.

Figure 9:
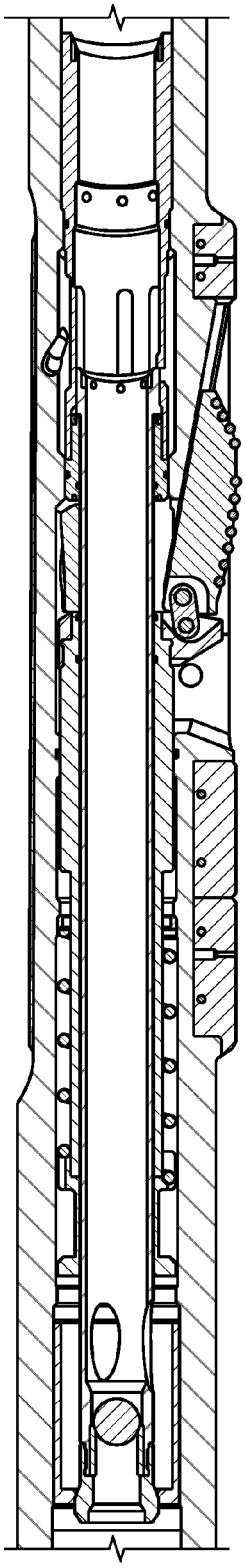
(PRIOR ART) FIG. 9
FIGS. 9 and 9*a* show one example of a prior art reamer blade actuation tool respectively in the retracted and extended positions.
Figure 9A:
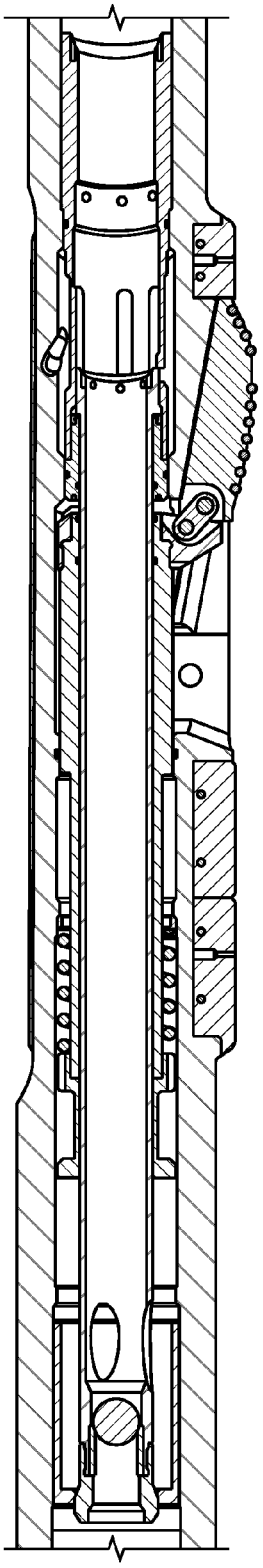
(PRIOR ART) FIG. 9a

Tool 52 (typical a standard hole enlargement reamer tool with known activation method such as pressure, flow rate, mechanical, downlink, electrical signal, RFID, RPM signals) can be supported on the drill string for liner drilling or on a running string for casing drilling or run in with the casing string and subsequently repositioned to the FIG. 4 position. Since FIG. 4 is schematic the actuating mechanism is shown in two positions, retracted at 68 and extended at 68'. A standard tool 52 can be seen in FIG. 9. The tools 52 actuation method of outward oriented blade expansion can be used to actuate the Liner or Casing Shoe reamer blades. Optionally centralizers 70 can be deployed to centralize the actuating mechanism 52 during extension. Extension of blades 58 can occur with simple alignment of the generically represented mechanism 68 which can optionally be at a fixed dimension. Alternatively, the mechanism 68 may be articulated when aligned with blades 58 to push them out radially. Mechanism 68 can be an inflatable, a shape memory alloy, an articulated linkage, a swelling member or other structure strong enough to hold the blades 58 extended to ream the borehole at a dimension indicated at 72 to a dimension indicated at 74. The clearance difference between these two locations and the outer surface 66 can be in the range of up to 30%.

Figure 5:
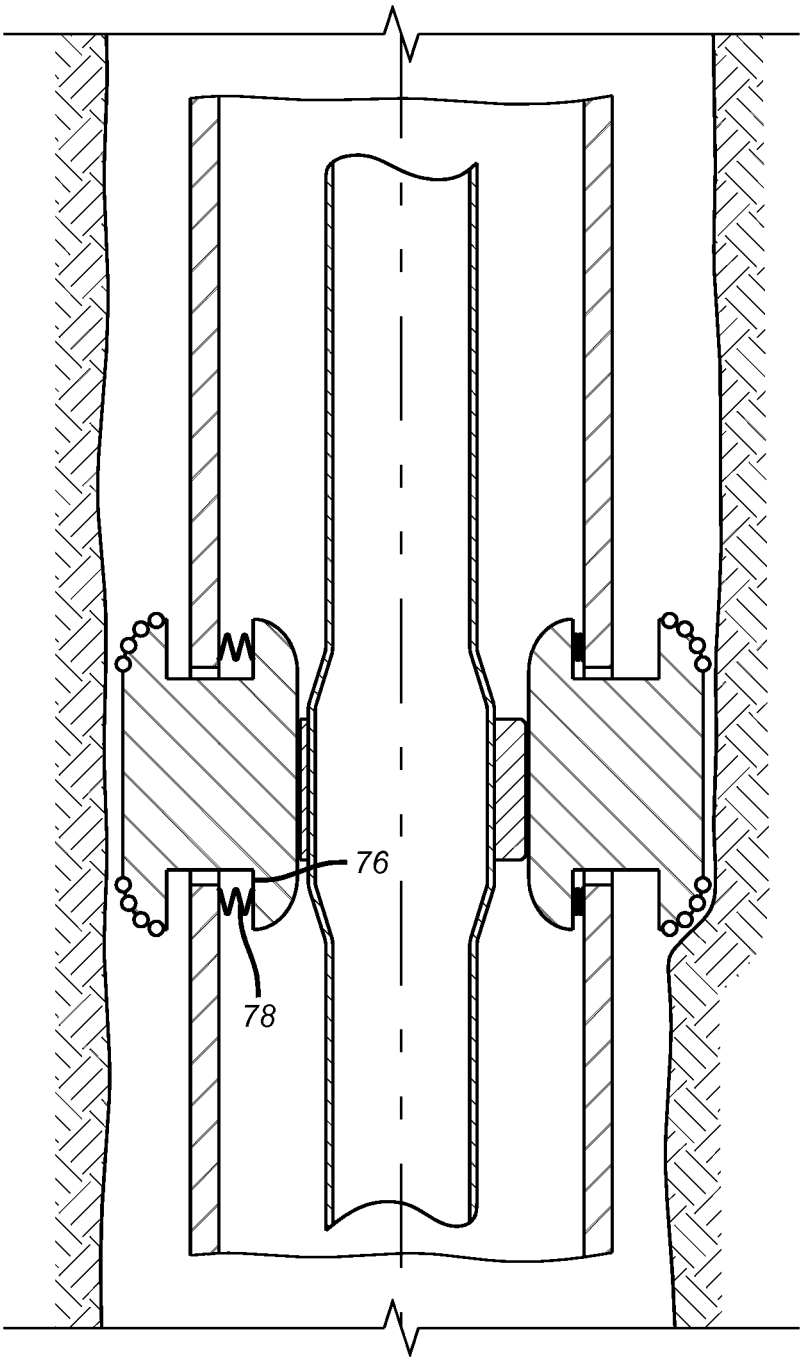
FIG. 5 is an alternative embodiment to FIG. 4 showing a way to retain the reaming blades to the tubular when reaching full extension.

FIG. 5 is a similar structure but adds a feature of a travel stop 76 with a return spring or other potential energy source 78. The two can be used together or the travel stops 76 can be used alone. The biased retracted position is shown on the left of the FIG. 5 and the extended position to the right. The operation is otherwise the same as FIG. 4.

After the casing or liner 50 is positioned where desired, the tool 52 is removed and a cementing shoe delivered and latched at 54 and cementing in a known manner can take place. Alternatively, the cementing shoe can be delivered below the tool 52.

Figure 6:
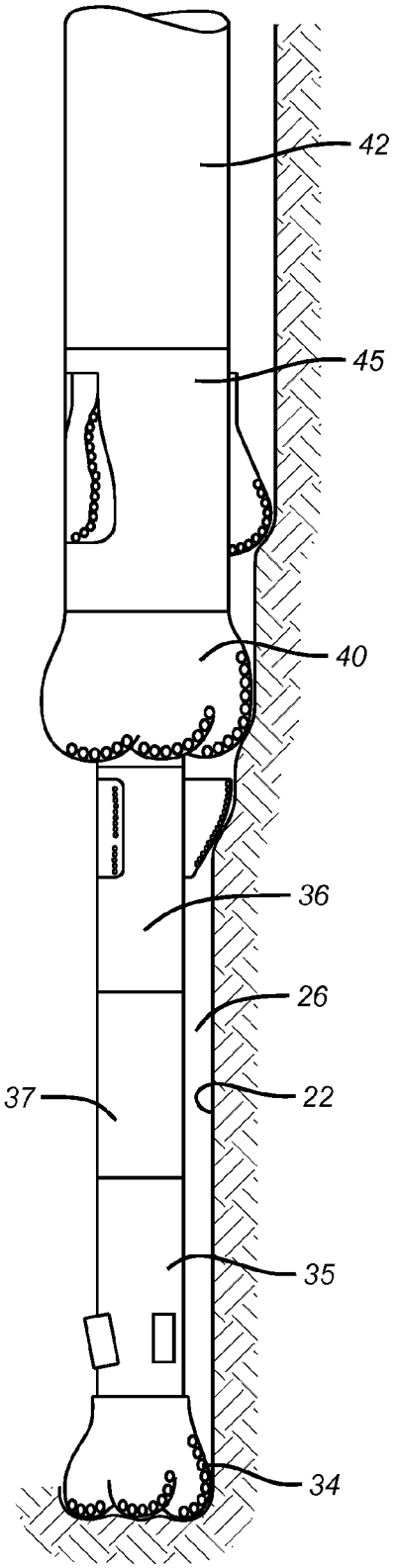
FIG. 6 shows the use of an articulated reamer above the fixed liner shoe extends beyond the tubular outer surface and that is articulated from within.
Figure 7:
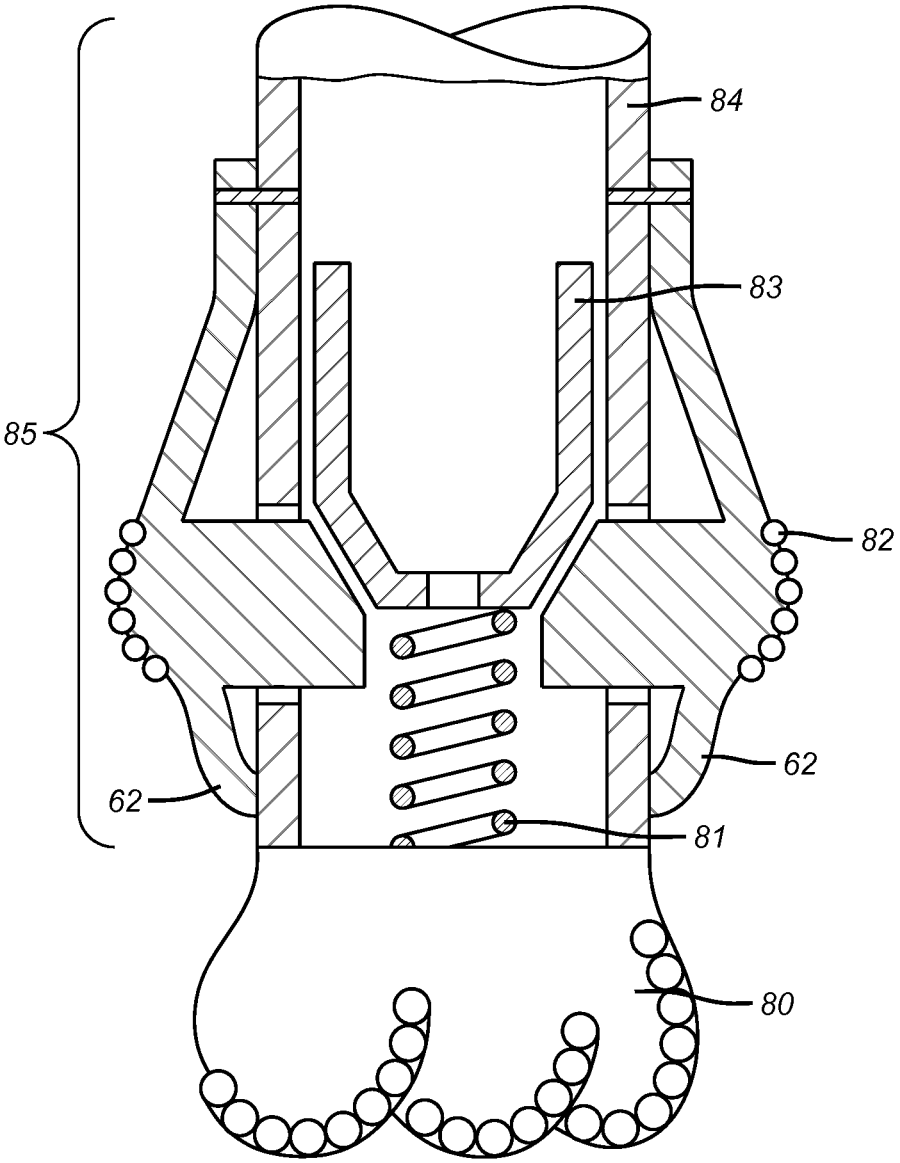
FIG. 7 shows the use of an articulated reamer above a Casing Drill Bit and that is articulated from within via flow rate and spring force.

FIG. 6 represents the invention furthering the described liner drilling set up from FIG. 2 by adding articulated reamer 45 on top of the fixed reamer blade 40. When the reamer 45 is activated the annulus for the liner 42 towards the borehole wall is significantly increased. FIG. 7 shows a reamer shoe 85 on top a casing drill bit 80. Actuation in this device is achieved by flowing through a restrictor 83 which pushes down against the spring force. As long as flow is going through the port in 83 the blades are extended. When flow ceases the spring 81 pushes the restrictor 83 up and blades 82 can retract back into the casing 84.

Figure 8:
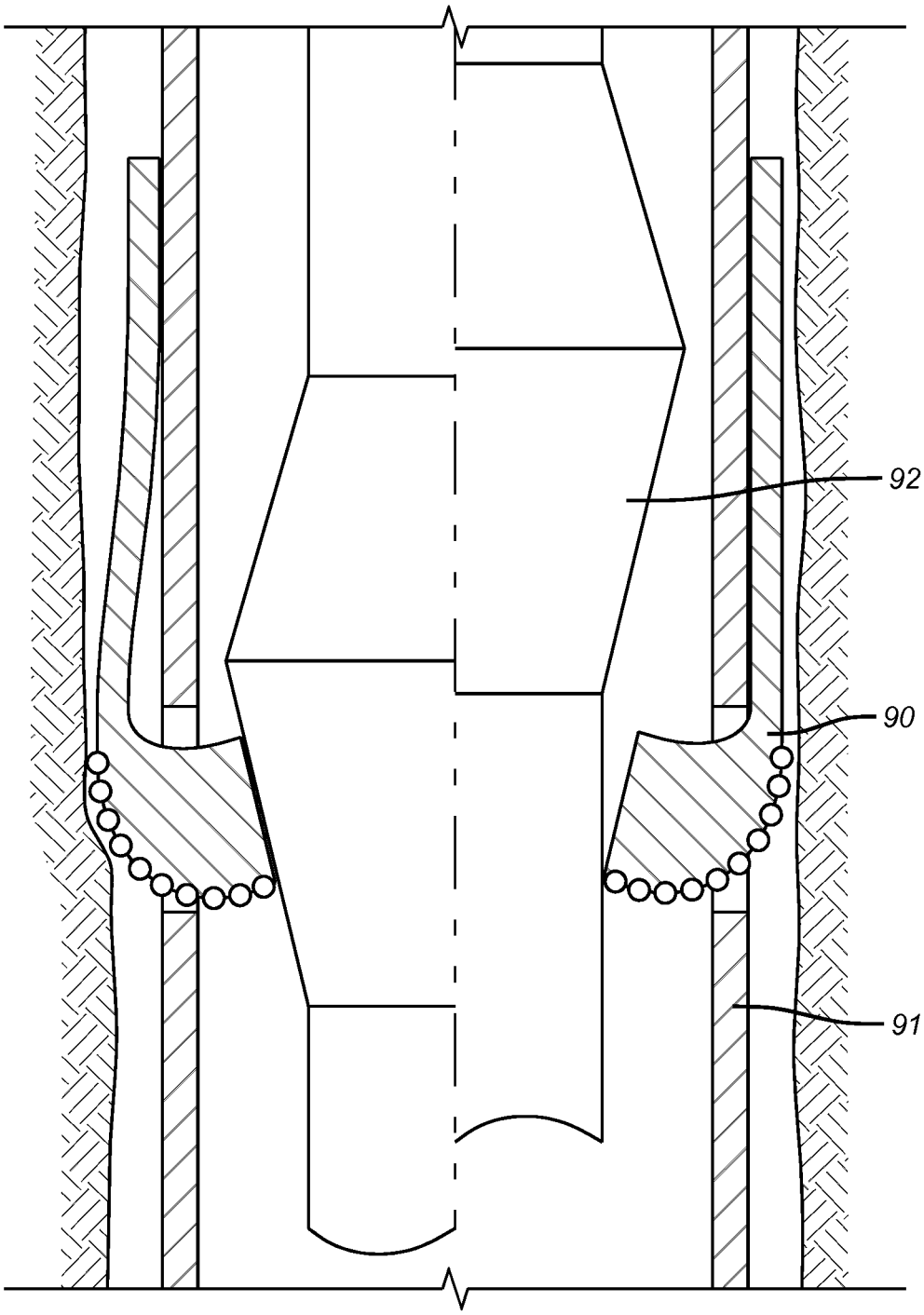
FIG. 8 is an alternative embodiment to FIG. 4 showing a way to articulate the reaming blades to the tubular via mechanical wedge action of an inner string.

FIG. 8 shows an alternative method of activating reamer blades as seen in FIG. 4 and FIG. 5. The blades 90 are extended by mechanically pushing a cone 92 downward and thereby displacing the blades 90 radially outwardly of casing string 91. Upward movement of the inner string allows the reamer blades to retract. This can be achieved by weight application during drilling, or with hydraulically extending tools (i.e. Baker Hughes Thruster tools).

The above description is illustrative of the preferred embodiment and many modifications may be made by those skilled in the art without departing from the invention whose scope is to be determined from the literal and equivalent scope of the claims below:

We claim:

1. A casing or liner drilling and reaming assembly, comprising:

a tubular casing string or liner string associated with a bit such that said string advances in tandem with said bit as said bit makes more hole;

an articulated reaming tool mounted directly along said string to enlarge the hole made by said bit, said reaming tool selectively extendable by an actuation tool that is subsequently removable from said tubular casing string or liner string that remains in the hole.

2. The assembly of claim 1, wherein:

said reaming tool extends through at least one wall opening in said string.

3. The assembly of claim 1, wherein:

said reaming tool further comprises at least one travel stop to limit extension from said string.

4. The assembly of claim 1, wherein:

said reaming tool is biased toward said string.

5. The assembly of claim 1, wherein:

said reaming tool is articulated with a force delivered from within said string.

6. The assembly of claim 5, wherein:

said force is delivered from an actuation tool independently supported on a tubular string from said casing or liner string.

7. The assembly of claim 6, wherein:

said actuation tool is centralized in said casing or liner string with a centralizer.

8. The assembly of claim 6, wherein:

said actuation tool rotates in tandem with said casing or liner string.

9. The assembly of claim 6, wherein:

said actuation tool comprises at least one protrusion that forces said reaming tool out of said casing or liner string when aligned with blades forming said reaming tool.

10. The assembly of claim 9, wherein:

said protrusion selectively changes in radial dimension.

11. The assembly of claim 10, wherein:

said protrusion comprises one selected from the group consisting of an inflatable, a shape memory alloy, an articulated linkage and a swelling material.

12. The assembly of claim 6, wherein:

said actuation tool is actuated by at least one of pressure, flow rate, mechanical, downlink, electrical signal, RFID, RPM signals.

13. The assembly of claim 5, wherein:

said force is delivered from said actuation tool separately supported from said casing or liner string.

14. The assembly of claim 5, wherein:

said actuation is mechanically or hydraulically actuated.

15. The assembly of claim 1, wherein:

said reaming tool is formed at least in part from a wall portion of said string.

16. The assembly of claim 1, further comprising:

a fixed reaming tool on said string;

said articulated reaming tool selectively extendable further than said fixed reaming tool.

17. The assembly of claim 1, wherein:

said articulated reaming tool is mounted either externally to said string with bias into a wall opening in said string or internally to said string and movable out through said wall opening exclusively with radial movement to enlarge the hole made by said bit.

18. A drilling and reaming assembly, comprising:

a tubular casing string or liner string associated with a bit such that said string advances in tandem with said bit as said bit makes more hole;

an articulated reaming tool mounted to said string to enlarge the hole made by said bit;

said reaming tool is biased toward said string;

said bias comes from at least one elongated support mounted to an outer surface of said string supporting a respective blade of said reaming tool on an end of said support.

19. The assembly of claim 18, wherein:

said at least one elongated support on said respective blade further comprises a plurality of supports extending respectively from opposed ends thereof and secured to said outer surface of said string.

20. The assembly of claim 18, wherein:

said reaming tool comprises a plurality of said blades each independently supported and further comprising a cutting structure that enlarges the borehole made by said bit.

21. A liner or casing string drilling method, comprising:

advancing the casing or liner string with a bit operatively connected thereto;

reaming the hole made by said bit with an articulated reamer mounted directly along said casing or liner string;

articulating said reamer with a removable actuation tool;

supporting said reamer on an outer surface of said casing or liner or in at least one opening in a wall of said casing or liner string;

removing said removable actuation tool while leaving the casing or liner string in the hole.

22. The method of claim 21, comprising:

extending said reamer through at least one wall opening in said casing or liner string.

23. The method of claim 22, comprising:

biasing said reamer toward said casing or liner string;

providing a travel stop for said reamer in a direction extending away from said casing or liner string.

24. The method of claim 22, comprising:

applying a force to said reamer from within said casing or liner string;

providing on said actuation tool, supported independently within said casing or liner string, a projection aligned with blades of said reamer for extension of said blades upon movement of said actuation tool.

25. The method of claim 21, comprising:

supporting said reamer on an outer surface or in the wall of said casing or liner string.

26. The method of claim 21, comprising:

cementing said casing string or liner string after said removing.

* * * * *